US005858221A

United States Patent [19]

Conrad

[11] Patent Number: 5,858,221

[45] Date of Patent: Jan. 12, 1999

[54] POOL CLEANING TOOL WITH REPLACEABLE SCUFF EDGE BASKET

[76] Inventor: James R. Conrad, 1518 Moffett St., Salinas, Calif. 93905

[21] Appl. No.: 944,909

[22] Filed: Oct. 6, 1997

[51] Int. Cl.[6] ..... E04H 4/16

[52] U.S. Cl. ..... 210/169; 210/238; 210/470; 15/1.7

[58] Field of Search ..... 210/169, 232, 210/238, 470; 15/1.7

[56] References Cited

U.S. PATENT DOCUMENTS

| | | | |
|---|---|---|---|
| 4,140,634 | 2/1979 | Harry | 210/169 |
| 4,152,801 | 5/1979 | Lieber | 210/169 |
| 4,481,117 | 11/1984 | Collins | 210/169 |
| 4,820,411 | 4/1989 | Lempio | 210/169 |
| 5,173,181 | 12/1992 | McFarland | 210/169 |
| 5,342,513 | 8/1994 | Wall et al. | 210/169 |
| 5,662,797 | 9/1997 | Varrassi | 210/169 |
| 5,705,058 | 1/1998 | Fischer | 210/169 |

*Primary Examiner*—Jay H. Woo
*Assistant Examiner*—Betsey J. Morrison
*Attorney, Agent, or Firm*—Louis J. Bachand

[57] ABSTRACT

A low cost, repairable pool cleaning tool for cleaning debris from a pool bottom wall, comprising a mesh fabric debris receiver having a perimetrical portion, a frame supporting the mesh fabric receiver by its perimetrical portion for debris reception, a protective sleeve surrounding the frame against contact with the pool bottom wall, and a pole attached to said frame for manipulating the receiver in the pool to gather debris from the pool, the mesh fabric being adhesively bonded to the frame or to the sleeve for ease of manufacture and for ready replacement and repair. The tool further includes positive clamping of the fabric mesh at the pole connection to the frame, and a rotatable and removable scrubber lip journaled on the sleeve.

24 Claims, 4 Drawing Sheets

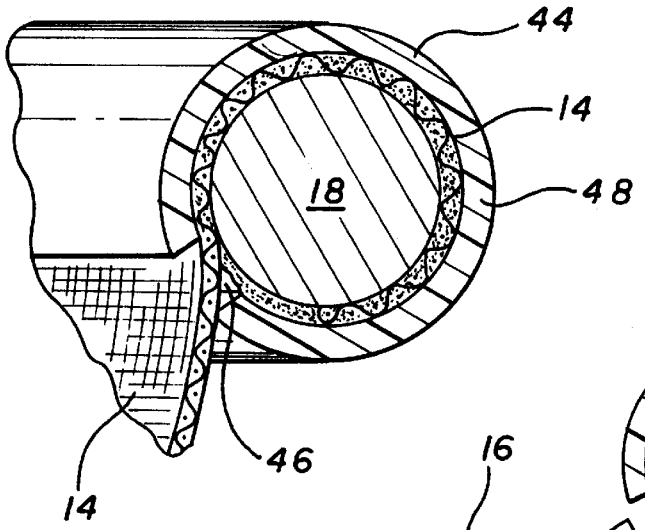
FIG. 2C
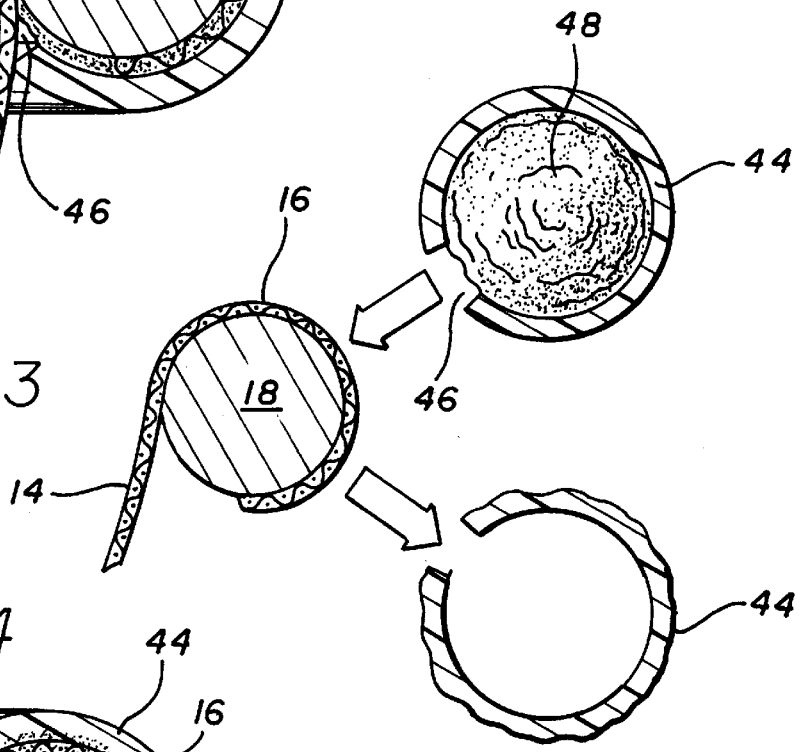
FIG. 3
FIG. 4
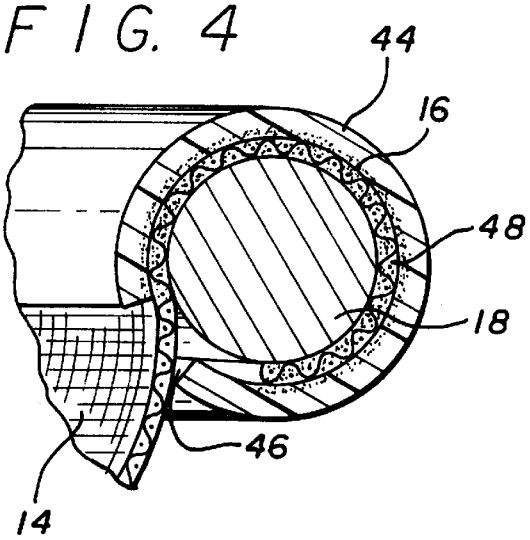
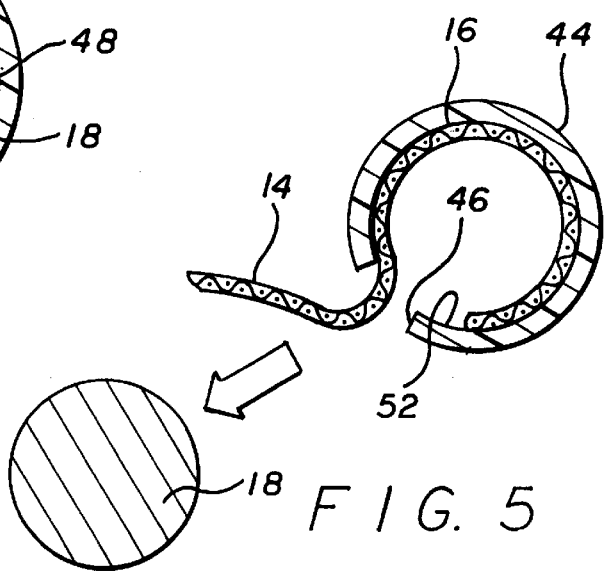
FIG. 5

POOL CLEANING TOOL WITH REPLACEABLE SCUFF EDGE BASKET

This invention has to do with pool cleaning tools of the type that are extended into and dragged through swimming pools, ponds and spas (all of which are referred to as pools herein) for the purpose of removing leaves and other debris that accumulates on the pool bottom. Suitable tools for this purpose generally comprise a basket or receiver which is typically made of mesh fabric, a frame which gives shape to the basket and defines the receiving opening, and a handle, usually an extendible pole with which the basket is manipulated to gather in the debris.

BACKGROUND OF THE INVENTION

Pool cleaning tools, particularly from the perspective of the pool cleaning professional, should be longer lasting, lighter weight and less costly. Presently known designs of pool cleaning tools typically use a stainless steel tubing bead to clamp the basket fabric to the frame and to act as a glide on the pool bottom surface. While apparently durable, such tool constructions are unduly heavy, particularly when associated with a steel pole, and upon eventual wear can not be refurbished short of reconstruction, which is not practicable in the field. The present tools are therefore frequently replaced aggravating the expense problem inherent in using high cost materials. In addition, the cleaning effectiveness of existing pool cleaning tools is less than desired as the metal to plaster contact involves two rigid materials and small surface variations are not accommodated.

SUMMARY OF THE INVENTION

It is an object therefore to provide an improved pool-cleaning tool. It is another object to provide a lower weight, more effective pool cleaning tool. Another object is to provide a pool-cleaning tool in which the mesh fabric basket is supported on the tool frame by adhesive. Another object is to provide a pool cleaning tool in which the mesh supporting frame has a plastic sleeve surrounding the frame to act as a scuffable protector of the frame and adhered mesh and to better glide over the pool bottom wall, following its small surface variations. The invention further contemplates providing a new method of manufacturing pool cleaning tools in which the mesh fabric basket is adhered to the frame, and the adhesive is carried to the mesh fabric/frame engagement with a plastic sleeve which is nonadherent to the adhesive but which will snap onto the frame to enclose the frame and adhered mesh fabric as a scuffable protector for the frame. A further object is to provide a pool-cleaning tool, which is repairable in the field by replacement of the plastic scuff sleeve. A further object is to provide a pool cleaning tool and method for its manufacture in which mesh fabric and the plastic sleeve are joined together as a subassembly and put onto the frame to complete the tool. It is a further object to provide a repairable pool-cleaning tool in which the mesh fabric and the sleeve are replaceable as needed by simply snapping a new mesh fabric and sleeve subassembly onto the tool frame in place of the worn one.

These and other objects of the invention to become apparent hereinafter are realized in a pool cleaning tool for cleaning debris from a pool bottom wall, in which the tool comprises a mesh fabric debris receiver having a perimetrical portion, a frame supporting the mesh fabric receiver by its perimetrical portion for debris reception, a protective sleeve surrounding the frame against contact of the tool frame with the pool bottom wall, the frame being adapted to having a pole attached for manipulating the receiver in the pool to gather debris from the pool, the mesh fabric being attached to the frame with adhesive supported against the frame and mesh fabric by the sleeve.

In this and like embodiments, typically: the sleeve is longitudinally split to receive the frame and mesh fabric perimetrical portion; the sleeve comprises plastic not bondable by the adhesive, whereby the sleeve is removable from and replaceable on the frame in the frame and mesh fabric perimetrical portion adhesive-supported condition; the sleeve comprises a polyolefin plastic; and there is further included a pole for manipulating the receiver in the pool and a bracket having first and second opposed portions, each opposed portion defining a recess for cooperating reception of the frame in supporting relation, the bracket portions being jointly received by the pole in frame attaching relation to the pole, and fastened together in that condition.

In other aspects of the invention, typically: the frame has a pair of ends, the bracket portion recesses defining cooperating J shaped slots to receive and retain the frame ends; the adhesive is carried in the sleeve to an assembly of the frame and mesh fabric perimetrical portion, and hardened in situ about the frame and the mesh fabric portion; the sleeve is longitudinally split to receive the frame and mesh fabric perimetrical portion; the sleeve comprises plastic not bondable by the adhesive, whereby the sleeve is removable from and replaceable on the frame in the frame and mesh fabric perimetrical portion adhesive-supported condition; the sleeve comprises a polyolefin plastic; and there is further included a bracket having first and second opposed portions, each portion defining a recess for cooperating reception of the frame in supporting relation, the bracket portions being jointly receivable by a manipulating pole in frame attaching relation to the pole, and fastened together in that condition, the bracket supporting the pole immediately adjacent the frame.

In a further embodiment, the invention provides a pool cleaning tool for cleaning debris from a pool bottom wall, the tool comprising a mesh fabric debris receiver having a perimetrical portion, a frame supporting the mesh fabric receiver by its perimetrical portion for debris reception, a protective sleeve surrounding the frame against contact of the tool frame with the pool bottom wall, and a pole attached to the frame for manipulating the receiver in the pool to gather debris from the pool, the mesh fabric being fixed, e.g., adhesive bonded, only to the sleeve and supported on the frame by the sleeve.

In this and like embodiments, typically: the sleeve is longitudinally split to receive the adhesive and the mesh fabric perimetrical portion in bonding relation, and the frame in supported relation; the sleeve comprises plastic bondable by the adhesive, whereby the sleeve and mesh fabric are removable from and replaceable on the frame in frame supported relation; the sleeve comprises an adhesive-adherent plastic; there is further included a bracket having first and second opposed portions, each portion defining a recess for cooperating reception of the frame in supporting relation, the frame has a pair of ends, the bracket portion recesses defining cooperating J shaped slots to receive and retain said frame ends, the bracket portions being jointly received by the pole in frame attaching relation to the pole, and fastened together in that condition; the bracket supports the pole immediately adjacent the frame; the sleeve is longitudinally split to receive the adhesive and the mesh fabric perimetrical portion in bonding relation, and the frame in supported relation; the sleeve comprises plastic bondable by the adhesive, whereby the sleeve and mesh fabric are removable from and replaceable on the frame as a unit in frame supported relation.

In a highly particular embodiment of the invention pool cleaning tool, the tool includes projecting from the sleeve a lip adapted for flexibly following the contour of the pool in scrubbing relation to clean debris. Typically, the tool frame has a circular cross-section portion, the lip comprising a lip element and a base therefor, the lip base having an elongated recess of generally circular cross-section opening away from the lip element and adapted to journal on the frame portion in rotatable relation for pool wall contact in multiple angularly-indexed positions for scrubbing said pool wall, e.g., to present the lip leading edge to the pool wall.

BRIEF DESCRIPTION OF THE DRAWING

The invention will be further described in conjunction with the attached drawings in which:

FIGS. 2*a*–2*c* are views in vertical section, and partly schematic, of the assembly of the pool cleaning tool frame and mesh fabric with the addition to the assembly of adhesive carried in the sleeve;

FIG. 3 is a view like FIGS. 2*a*–2*c* showing the removability of the sleeve following adhesion of the mesh fabric to the frame;

FIG. 4 is a fragmentary view of an alternative embodiment in which the sleeve and mesh fabric are first fully assembled and then attached to the frame;

FIG. 5 is a view like FIGS. 2*a*–2*c* but of the alternative embodiment, showing the attachment of the preassembled mesh fabric and sleeve to the frame;

DETAILED DESCRIPTION

Figure 1:
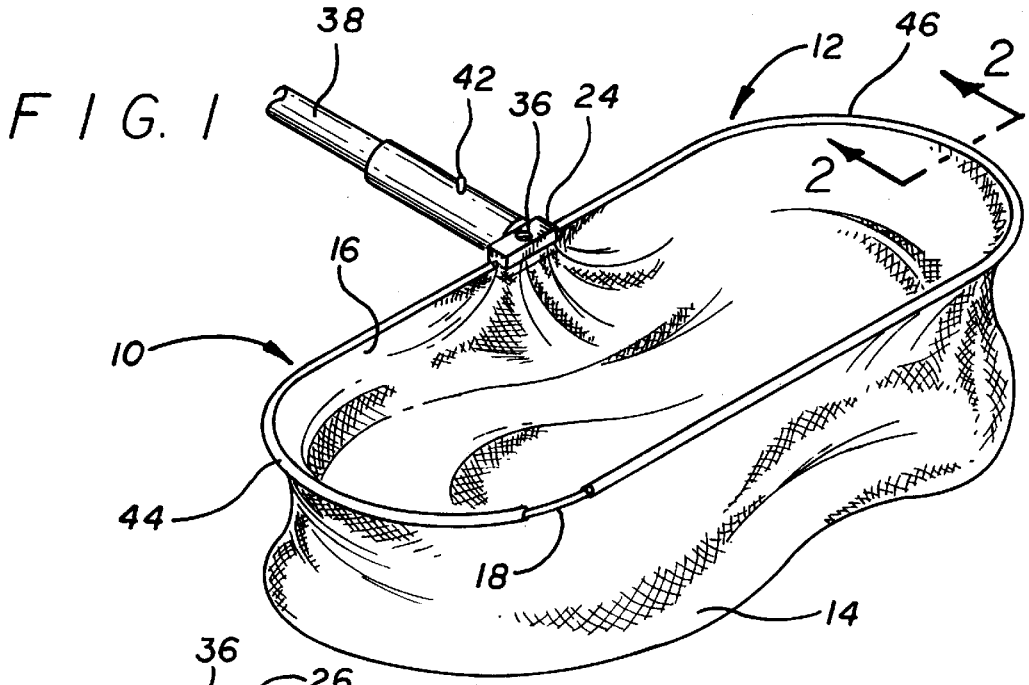
FIG. 1 is an axonometric view of the invention pool-cleaning tool.
Figure 1A:
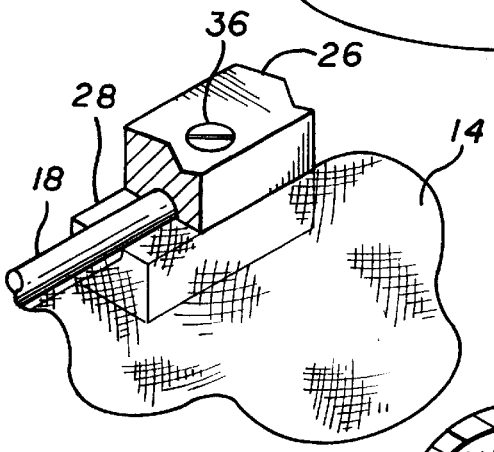

As noted above, the improved pool-cleaning tool of the invention uses a plastic sleeve and adhesive rather than the conventional stainless steel clip or a plastic clip as the sole support. The steel clip was used to hold the mesh fabric in place and to protect the tool frame from wear. In this invention, in one embodiment, an adhesive delivered to the frame and mesh fabric by a sleeve holds the mesh fabric which then doubles as a protective covering for the frame. That is, the mesh fabric is supported in place by adhesive that is suitably carried to the locus of adhesion in the plastic sleeve. The plastic sleeve is removable to enable replacement after wearing. Alternatively, the sleeve and mesh are preassembled together, in bonded relation, and attached to the frame by the tension of the sleeve on the frame. In this latter case the mesh fabric and the sleeve can be replaced together upon undue wear.

With reference now to the drawings, in FIGS. 1–3 and 8, the pool cleaning tool 10 comprises a receiver 12 formed by mesh fabric 14 shaped into a basket 15 and having a perimetrical edge 16 adhered to and possibly wrapped around an open mouth frame 18 as shown. The frame 18 (FIG. 8) comprises a suitably shaped wire, suitably circular in cross-section, for purposes to appear, whose ends 22 are captured in a bracket 24 having first and second opposed portions 26, 28 which define end-receiving recesses 32, 34. The bracket portions 26, 28 are held together by a screw 36 and also are received internally (or externally) by the pole 38 used to manipulate the cleaning tool receiver 12, and held by a conventional button-depressible plastic clip 42 which can be shifted to unlock the bracket 24 from the pole. The mesh fabric 14 is clamped between the opposed bracket portions 26, 28, eliminating a source of debris leakage past the mesh and further securing the mesh in place on the frame 18.

The bracket 24 is specially designed to prevent pullout of the frame 18 from the bracket. Rather than gather the frame ends 22 together and put them together into the bracket 24, the frame ends 22 are separately placed in individual, oppositely facing, "J" shaped, curvilinear slots 23, 25 defined in and by the recesses 32, 34. The ends 22 are clamped there by assembly of the bracket portions 24, 26 described above. By having curvilinear slots 23, 25, the bracket 24 positively retains the frame ends 22, blocking their removal by the binding of their curvature in the slots in case of any outward movement of the ends. With further reference to the bracket 24 it will be noted here, as well as elsewhere herein, that mesh fabric 14 is also clamped between the bracket portions 24, 26 to ensure complete encirclement of the frame 18 by the mesh, as well as to block incipient loss of the fabric mesh.

A plastic sleeve 44 having a longitudinal slit 46 is placed about the frame 18 except in the area of bracket 24. The manner of placing the sleeve 44 will now be described.

Figure 2A:
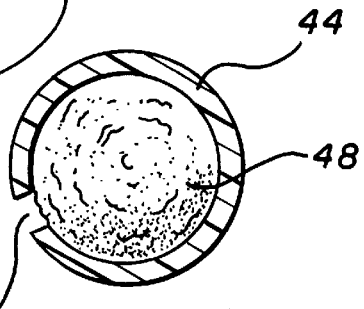
Figure 2B:
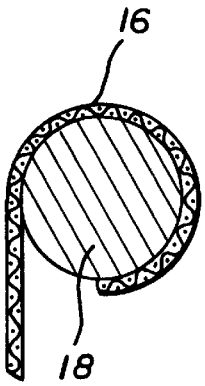
Figure 2B:
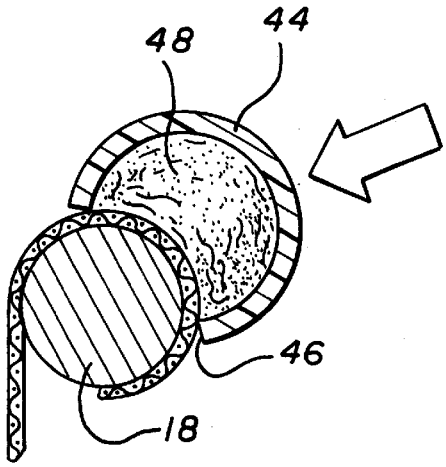

The manufacture of the invention cleaning tool is highly advantageous in terms of ease, efficiency and cost. Instead of using cumbersome metal forming jigs to bend a steel sleeve into a clip to retain the mesh fabric in place on the frame, the invention uses the plastic sleeve 44 and adhesive 48. The tool 10 manufacturing steps are shown in FIGS. 2*a*–2*c*. First, the mesh fabric 14, generally in the shape of basket 15, is draped about the frame 18 so that the fabric perimetrical edge 16 overlies the frame, extending, e.g., about 275 degrees around the frame circumference. More or less of edge 16 can overlie the frame 18. Keeping the mesh fabric 14 in place, with basket 15 defined thereby, the plastic sleeve 44 is brought to the fabric perimetrical edge 16 and frame 18 locus, after incorporating a quantity of flowable adhesive 48 into the sleeve, as shown in FIG. 2*a*. The sleeve 44 is pressed longitudinal slit 46 first onto the frame 18 as shown in FIG. 2*b*. The sleeve 44 finally seats fully on the frame 18 and its contained adhesive 48 penetrates the interstices of the mesh fabric to the frame 18 surface where it sets, bonding the mesh fabric to the frame, either chemically or mechanically or both.

The quantity of adhesive 48 is not narrowly critical, but it should be an amount, given the flowability characteristics of the adhesive, set time of the adhesive, the mesh size of the fabric mesh, ambient temperatures during manufacture, and other manufacturing factors, that will assure firm bonding of the mesh fabric 14 onto the frame 18. The chemical nature of the adhesive is not narrowly critical with any metal bonding adhesive being suitable, provided its flow characteristics, set times, final strength and water resistance properties are compatible with the application, including compatibility with the mesh fabric 14 which is generally a polyolefin plastic net. Suitable adhesives include epoxy, urethane, and other suitable polymeric materials.

FIG. 3 illustrates the removability of the sleeve 44 from the frame 18. The sleeve 44 is suitably made from polyethylene or other polyolefin plastic, or another material which if not already nonadherent to the adhesive is treated to be nonadherent, with lubricant for example, or given a lining. The removability of the sleeve 44 is advantageous, as scuffing of the tool 10 on the pool bottom will wear out the sleeve, possibly allowing marring of the pool bottom wall 72 (FIG. 7) during cleaning operations. Replacement of the sleeve 44 only, without having to replace the entire tool 10 is an economic advantage of the present invention to pool cleaning professionals as well as a boon to pool owners.

In an alternative embodiment, shown in FIGS. 4 and 5, the mesh fabric 14 is preattached to, or preassembled with the sleeve 44 by adhering the mesh fabric to the inner wall 52 of the sleeve. For this purpose a nonpolyolefin plastic sleeve, such as nylon, polyester, urethane, and like polymers can be used, or a polyolefin treated to be adherent, as by oxidation of the surface, can be used with conventional adhesives such as those noted above, or special adhesives for attachment of plastics to plastics, tailored to the combination of materials being used, can be employed. With reference to FIG. 5, the preassembled mesh fabric 14 and sleeve 44 are brought to the frame 18 sleeve slit 46 first and snapped onto the frame as shown. In this embodiment, the spring force of the split sleeve 44 is sufficient to maintain the sleeve and fabric 14 combination on the frame 18. See FIG. 4. The advantage of this embodiment over previously known pool cleaning tools of this type is that the fabric mesh 14 can be readily replaced as well as the sleeve 44, a maintenance step that will keep the pool cleaners tools in top operating condition without the need to replace the frame 18 or incur that expense.

Figure 6:
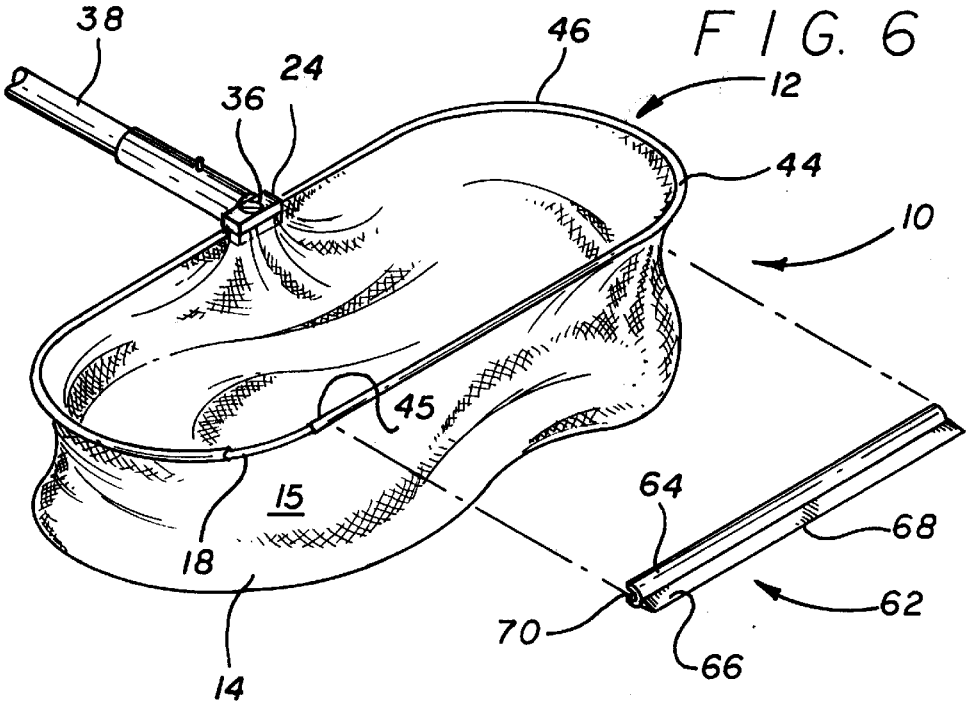
FIG. 6 is an axonometric view of the invention pool-cleaning tool with the scrubbing attachment shown.
Figure 7:
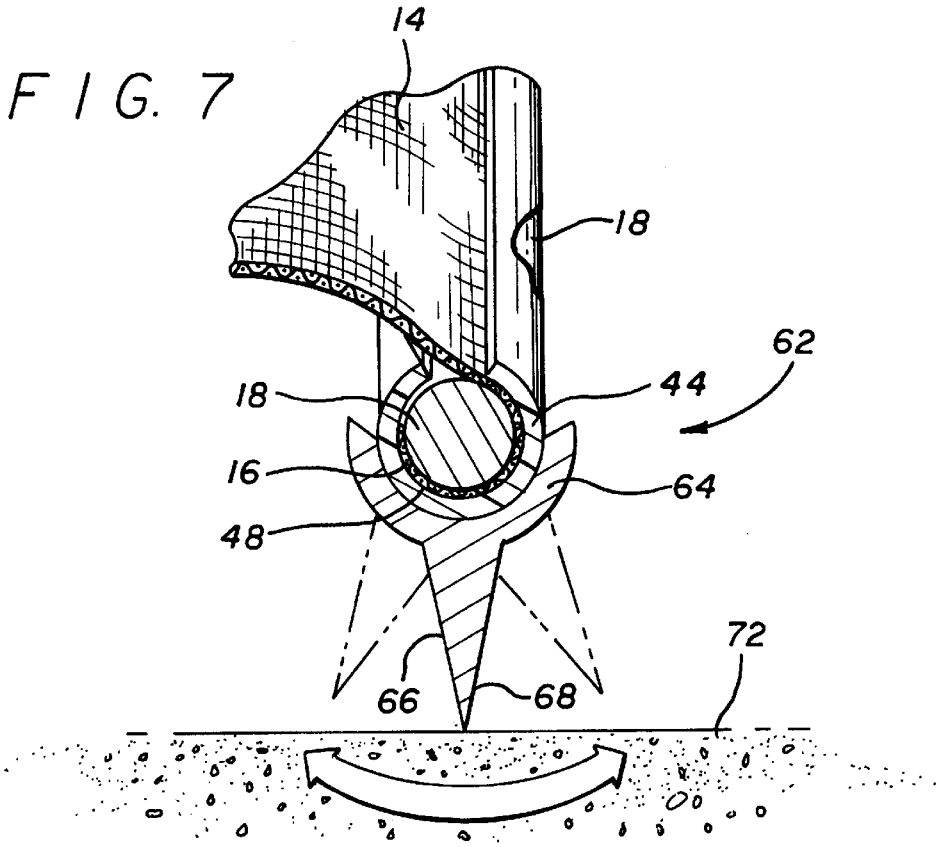
FIG. 7 is a view in vertical section of the pool cleaning tool and scrubbing attachment.
Figure 8:
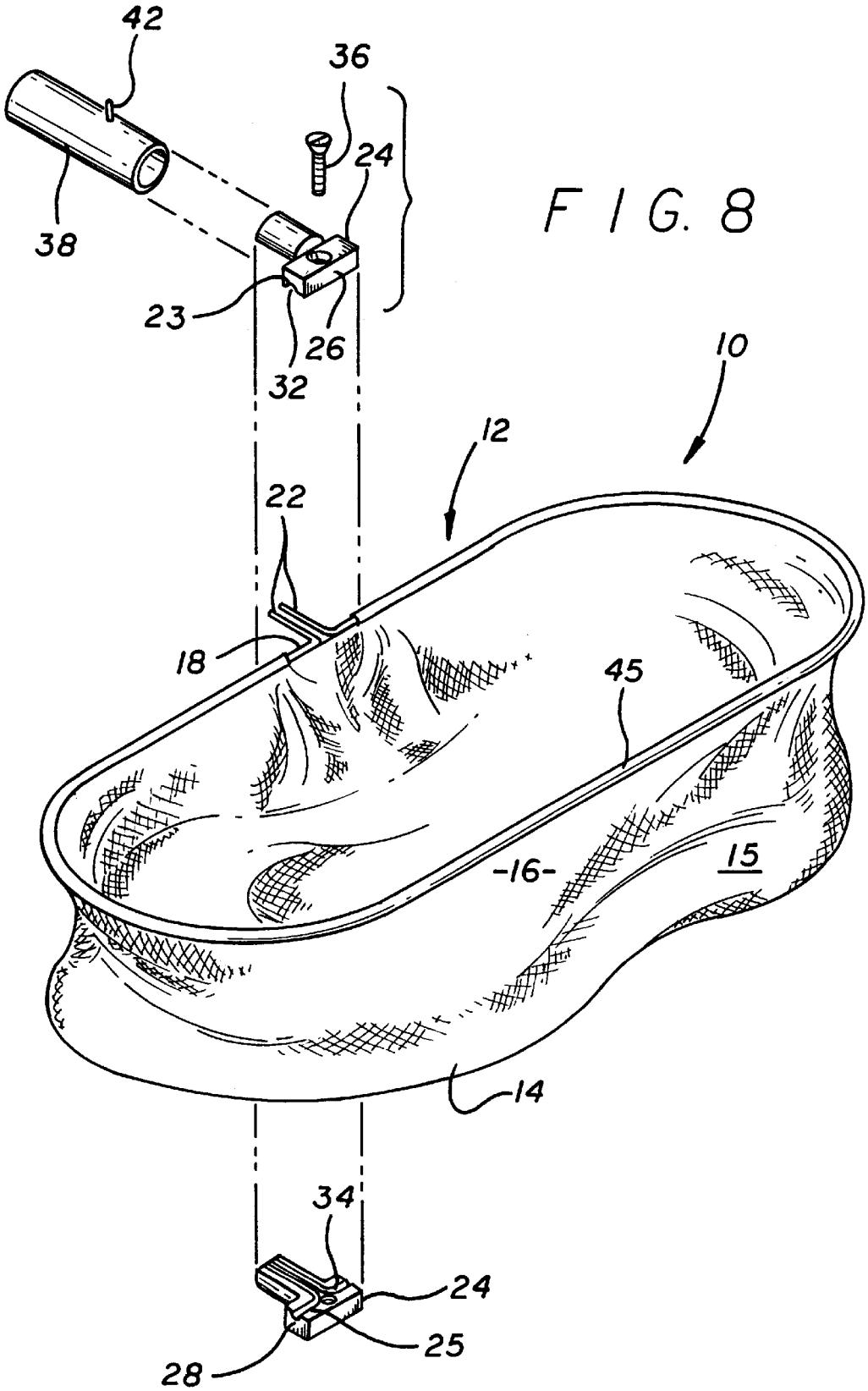
FIG. 8 is an exploded view of the tool bracket for connecting the receiver to the pole.

FIGS. 6 and 7 show a further aspect of the invention. In order to enhance the cleaning of the pool bottom wall 72, a scrubber lip 62 is provided. Scrubber lip 62 comprises a base 64 and a radially disposed, rigid, lip element 66, suitably of triangular cross-section and terminating in a feather tip 68 which is useful in scrubbing the pool wall 72. Base 64 is generally elongated so as to cover the length of the non-curved portion 45 of the sleeve 44. The base 64 has a longitudinal recess 70 opening away from the lip element 66 and is of generally circular cross-section, the recess being sized and shaped to snap onto the complementarily shaped portion 45 of the sleeve 44 as shown in FIG. 6. Or the scrubber lip 62 may be integrated with the sleeve 44 as a one-piece plastic molding (not shown). Once in place the scrubber lip 62 is useful to wipe the pool wall 72 as an extension of the receiver 12, its tip 68 acting to dislodge and gather debris that might otherwise be missed. Where the scrubber lip 62 is a separate element from the sleeve 44, and is journaled on the sleeve portion 45, the scrubber lip can rotate to present the lip element 66 at different positions relative to the pool wall 72, See FIG. 7, for optimum cleaning efficiency.

The invention accordingly provides an improved, lower weight, and more effective pool cleaning tool in which the mesh fabric basket is supported on the tool frame by adhesive and surrounded by a plastic sleeve acting as a scuffable protector of the frame and adhered mesh and serving to glide the tool over the pool bottom wall, following its small surface variations. The invention further provides a new method of manufacturing pool cleaning tools in which the mesh fabric basket is adhered to the frame, and the adhesive is carried to the mesh fabric/frame engagement with a plastic sleeve which is nonadherent to the adhesive but which will snap onto the frame to enclose the frame and adhered mesh fabric as a scuffable protector for the frame. The pool-cleaning tool of the invention is repairable in the field by replacement of the plastic scuff sleeve, the mesh or both according to the instant design, e.g., the mesh fabric and the sleeve are replaceable as needed by simply snapping a new mesh fabric and sleeve subassembly onto the tool frame in place of the worn one.

The foregoing objects are thus met.

I claim:

1. A pool cleaning tool for cleaning debris from a pool bottom wall, said tool comprising a mesh fabric debris receiver having a perimetrical portion, a frame supporting said mesh fabric receiver by its said perimetrical portion for debris reception, a protective sleeve surrounding said frame against contact of the tool frame with the pool bottom wall, and a pole attached to said frame for manipulating the receiver in the pool to gather debris from the pool, said mesh fabric being attached to said frame with adhesive, wherein said adhesive is supported against said frame and mesh fabric by said sleeve.

2. The pool cleaning tool according to claim 1, in which said sleeve is longitudinally split to receive said frame and mesh fabric perimetrical portion.

3. The pool cleaning tool according to claim 1, in which said sleeve comprises plastic not bondable by said adhesive, whereby said sleeve is removable from and replaceable on said frame when said fabric mesh is attached to said frame with adhesive.

4. The pool cleaning tool according to claim 1, in which said sleeve comprises a polyolefin plastic.

5. The pool cleaning tool according to claim 1, including also a bracket having first and second opposed portions, each said portion defining a recess for cooperating reception of said frame in supporting relation, said bracket portions being jointly received by said pole in frame attaching relation to said pole, and fastened together in that condition, said fabric being clamped between said bracket portions.

6. The pool cleaning tool according to claim 5, in which said frame has a pair of ends, said bracket portion recesses defining cooperating J shaped slots to receive and retain said frame ends.

7. The pool cleaning tool according to claim 1, in which said adhesive is carried in said sleeve to an assembly of said frame and mesh fabric perimetrical portion, and hardened in situ about said frame and said mesh fabric portion.

8. The pool cleaning tool according to claim 7, in which said sleeve is longitudinally split to receive said frame and mesh fabric perimetrical portion.

9. The pool cleaning tool according to claim 8, in which said sleeve comprises plastic not bondable by said adhesive, whereby said sleeve is removable from and replaceable on said frame when said fabric mesh is attached to said frame with adhesive.

10. The pool cleaning tool according to claim 9, in which said sleeve comprises a polyolefin plastic.

11. The pool cleaning tool according to claim 10, including also a bracket having first and second opposed portions, each said portion defining a recess for cooperating reception of said frame in supporting relation, said bracket portions being jointly received by said pole in frame attaching relation to said pole, and fastened together in that condition, said fabric being clamped between said bracket portions.

12. The pool cleaning tool according to claim 11, in which said frame has a pair of ends, said bracket portion recesses defining cooperating J shaped slots to receive and retain said frame ends.

13. A pool cleaning tool for cleaning debris from a pool bottom wall, said tool comprising a mesh fabric debris receiver having a perimetrical portion, a frame supporting said mesh fabric receiver by its said perimetrical portion for debris reception, a protective sleeve surrounding said frame against contact of the tool frame with the pool bottom wall, and a pole attached to said frame for manipulating the receiver in the pool to gather debris from the pool, said mesh fabric being fixed only to said sleeve and supported on said frame by said sleeve.

14. The pool cleaning tool according to claim 13, in which said mesh fabric is adhesive bonded to said sleeve.

15. The pool cleaning tool according to claim 14, in which said sleeve is longitudinally split to receive said adhesive and said mesh fabric perimetrical portion in bonded relation, and said frame in supported relation.

16. The pool cleaning tool according to claim 15, in which said sleeve comprises plastic bondable by said adhesive, whereby said sleeve and mesh fabric is removable from and replaceable on said frame in frame supported relation.

17. The pool cleaning tool according to claim 16, in which said sleeve comprises an adhesive-adherent plastic.

18. The pool cleaning tool according to claim 13, including also a bracket having first and second opposed portions, each said portion defining a recess for cooperating reception of said frame in supporting relation, said bracket portions being jointly received by said pole in frame attaching relation to said pole, and fastened together in that condition.

19. The pool cleaning tool according to claim 18, in which said fabric mesh is clamped between said bracket portions.

20. The pool cleaning tool according to claim 19, in which said bracket supports said pole immediately adjacent said frame.

21. The pool cleaning tool according to claim 14, in which said sleeve is longitudinally split to receive said adhesive and said mesh fabric perimetrical portion in bonding relation, and said frame in supported relation.

22. The pool cleaning tool according to claim 21 in which said sleeve comprises plastic bondable by said adhesive, whereby said sleeve and mesh fabric are removable from and replaceable on said frame in frame supported relation.

23. The pool cleaning tool according to claim 1, including also projecting from said sleeve a lip adapted for flexibly following the contour of the pool in scrubbing relation to clean debris.

24. The pool cleaning tool according to claim 22, in which said frame has a circular cross-section portion, said lip comprising a lip element and a base therefor, said lip base having an elongated recess of generally circular cross-section opening away from said lip element and adapted to journal on said frame portion in rotatable relation for pool wall contact in multiple angularly-indexed positions for scrubbing said pool wall.

* * * * *